United States Patent [19]

Trayer

[11] 4,365,227

[45] * Dec. 21, 1982

[54] METHOD AND APPARATUS FOR FUSING ELECTRICAL POWER EQUIPMENT ENCLOSED IN A TANK AND SURROUNDED BY INSULATING FLUID

[76] Inventor: Frank C. Trayer, 25690 LaLanne Ct., Los Altos Hills, Calif. 94002

[ * ] Notice: The portion of the term of this patent subsequent to Oct. 2, 1996, has been disclaimed.

[21] Appl. No.: 79,485

[22] Filed: Sep. 27, 1979

Related U.S. Application Data

[63] Continuation-in-part of Ser. No. 690,424, May 27, 1976, Pat. No. 4,170,000.

[51] Int. Cl.[3] ..... H01H 85/22; H01H 85/12

[52] U.S. Cl. ..... 337/202; 337/204; 337/251; 337/283

[58] Field of Search ..... 361/41, 334; 339/94 R, 339/112 L, 117 R; 337/1, 2, 3, 158, 194, 197, 202, 204, 248, 251, 283, 207, 277; 174/18; 200/144 C

[56] References Cited

U.S. PATENT DOCUMENTS

| | | | |
|---|---|---|---|
| 2,294,766 | 9/1942 | Williams | 337/204 |
| 2,713,098 | 7/1955 | Swain | 337/248 |
| 3,280,282 | 10/1966 | Rodeseike et al. | 337/158 |
| 3,309,477 | 3/1967 | Bronikowski | 337/158 |
| 3,475,693 | 10/1969 | Ristuccia | 337/1 |
| 3,829,810 | 8/1974 | Giegerich | 337/202 |
| 3,916,260 | 10/1975 | Westrom et al. | 361/41 |
| 4,170,000 | 10/1979 | Trayer | 337/204 |

*Primary Examiner*—William H. Beha, Jr.
*Attorney, Agent, or Firm*—Schapp and Hatch

[57] ABSTRACT

A vacuum fuse is mounted in an insulating oil filled tank containing electrical apparatus and is directly immersed in the insulating oil. A fuse ferrule contact block is suspended in the insulating oil. The suspension for the contact block permits insulating oil to contact the contact block over its entire surface. An opening in the tank top large enough to accommodate the fuse is located adjacent the contact block. One ferrule of the fuse is provided with a cylindrical extension to contact the contact block. The other ferrule is provided with an extension on which is mounted a bushing well and a cover plate.

11 Claims, 8 Drawing Figures

METHOD AND APPARATUS FOR FUSING ELECTRICAL POWER EQUIPMENT ENCLOSED IN A TANK AND SURROUNDED BY INSULATING FLUID

CROSS-REFERENCE TO RELATED APPLICATION

This application is a continuation-in-part of U.S. patent application Ser. No. 690,424, filed May 27, 1976, now U.S. Pat. No. 4,170,000, issued on Oct. 2, 1979.

BACKGROUND OF THE INVENTION

1. Field of the Invention

The present invention relates to method and apparatus for providing fusing for electrical apparatus, and more particularly to method and apparatus for providing fusing for submersible switchgear or submersible transformers which utilize plug-in bushings of the reconnectable, submersible type, or of providing fusing for padmounted switchgear or transformers utilizing the same type of bushings for "dead front" connection applications.

2. Description of the Prior Art

It has been proposed in the prior art relating to submersible electrical apparatus contained in insulating oil filled tanks to locate the fuses protecting that apparatus in fluid-tight insulating containers which project into the tanks. The fuses of this prior art are current limiting fuses, and the insulating containers are sealed to exclude insulating oil from contact with the fuses. Since the fuses of these prior art devices are maintained dry, with air insulation surrounding them, by insulating containers which seal them off from the surrounding oil, these prior art devices have a basic and serious limitation in that the heat generated by the fuses cannot effectively escape from the insulating containers except by conduction through their associated electrical conductors. It has been found, for example, that it is not reasonable to expect adequate heat dissipation when using fuses in these prior art devices which are rated above 40 amps at 15 kilovolts.

SUMMARY OF THE INVENTION

Accordingly, it is an object of the present invention to provide method and apparatus for fusing electrical apparatus located in insulating oil filled tanks whereby it is possible to make use of fuses rated at several hundreds of amperes at 15 kilovolts, or to make use of fuses of lesser current ratings at voltages exceeding 30 kilovolts.

Another object of the present invention is to provide improved method and apparatus for fusing submersible electrical apparatus of the kind enclosed in insulating fluid filled tanks.

Another object of the present invention is to provide method and apparatus for fusing submersible electrical apparatus enclosed in insulating fluid filled tanks wherein a blown fuse may be removed and replaced by means of an ordinary hook stick and a fuse clamp on an ordinary hot line tool.

A further object of the present invention is to provide method and apparatus whereby submersible electrical apparatus enclosed in insulating fluid filled tanks may be provided with fuses with minimal loss of tank top space.

A yet further object of the present invention is to provide method and apparatus for replaceably mounting fuses in submersible, insulating fluid filled electrical apparatus tanks with minimum increase in the tank size above that required to accommodate the electrical apparatus, thereby minimizing the cost of the tank, the cost of the insulating fluid, and the size of the enclosure in which the tank itself is mounted.

An additional object of the present invention is to provide method and apparatus for replaceably mounting fuses in submersible insulating fluid filled electrical equipment tanks in which it is practically necessary to remove the cable connector from the fuse bushing before replacing the fuse, and thus it is assured that the current flow through the fuse will be interrupted before the fuse is removed.

Yet another object of the present invention is to provide an inherently "dead front" fuse mount for mounting a fuse in a "padmount" insulating fluid filled electrical apparatus tank, such that no live parts are accessible when the fuse is in place and connected.

A further object of the present invention is to provide electrical apparatus in which outmoded types of fuses may readily be replaced with fuses of later, and available, type.

A yet further object of the present invention is to provide electrical apparatus protected by unitarily assembled combinations of fuses.

Other objects of the present invention will in part be obvious and will in part appear hereinafter.

The present invention, accordingly, comprises the several steps and the relation of one or more of such steps with respect to each of the others, and the apparatus embodying features of construction, combinations of elements, and arrangements of parts which are adapted to effect such steps, all as exemplified in the following detailed disclosure, and the scope of the present invention will be indicated in the appended claims.

In accordance with a principal feature of the present invention, electrical apparatus enclosed in an insulating fluid filled tank is fused by means of a vacuum fuse, or an assembly of different fuses, located in the same tank and immersed in the same body of insulating fluid.

In accordance with said principal feature of the present invention, said vacuum fuse, or said assembly of different fuses, is adapted to be removed from said tank by means of an opening in the top of said tank which communicates directly with the common body of insulating fluid containing said electrical apparatus and said fuse or fuses.

In accordance with another principal feature of the present invention, one ferrule of said vacuum fuse, or said fuse assembly, is provided with a coaxial, cylindrical extension adapted to tightly interfit and make solid contact with contacts located in a bore in a contact block.

In accordance with yet another principal feature of the present invention, the other ferrule of said vacuum fuse, or said fuse assembly, is provided with an extension terminating in a tapped hole, and the male stud of a commercially available bushing well is screwed into said tapped hole.

In accordance with yet another feature of the present invention, a sealing ring is provided around said opening in the top of said tank, and a cover plate is provided for said opening, said cover plate being adapted to engage said sealing ring and thus to water-tightly seal said opening in the top of said tank when clamped to said sealing ring.

In accordance with a further aspect of the present invention, an opening is provided in said cover plate, and said bushing well is fluid-tightly secured in said opening in said cover plate.

In accordance with a still further aspect of the present invention, both of said extensions are clamped to their associated ferrules of said fuse or fuses and thus a unitary fuse assembly is provided, comprising said coaxial cylindrical extension, said fuse or fuses, said extension terminating in a tapped hole, said bushing well, and said cover plate.

In accordance with an additional aspect of the present invention, a plurality of toggle clamps surrounding said sealing ring are provided for clamping said cover plate to said sealing ring, said toggle clamps being of a type which is easily operated from a distance by means of an ordinary hook stick.

In accordance with another aspect of the present invention, said contact block is suspended in said common body of insulating fluid within said tank by means of suspender members affixed to the inside surface of the top of said tank, so that the axis of said bore in said contact block passes through the center of said opening in the top of said tank in a direction substantially perpendicular to the top of said tank.

In accordance with still another feature of the present invention, said contact block is loosely affixed to the lower ends of said suspender members, so that said contact block can tilt slightly, or be slightly displaced, in order to accommodate possible misalignment between said cover plate and the axis of said coaxial cylindrical extension.

In accordance with a further aspect of the present invention, the face of said contact block facing the top of said tank is provided with a conical surface coaxial with said bore and concentric therewith, whereby said coaxial cylindrical extension is guided into said bore when said fuse is being replaced.

In accordance with another aspect of the present invention, the fuses of said assembly of different fuses are intercoupled by rigid coupling means which grippingly engage certain ones of their ferrules.

For a fuller understanding of the nature and objects of the present invention reference should be had to the following detailed description taken in connection with the accompanying drawings.

DESCRIPTION OF THE PREFERRED EMBODIMENT

Figure 1:
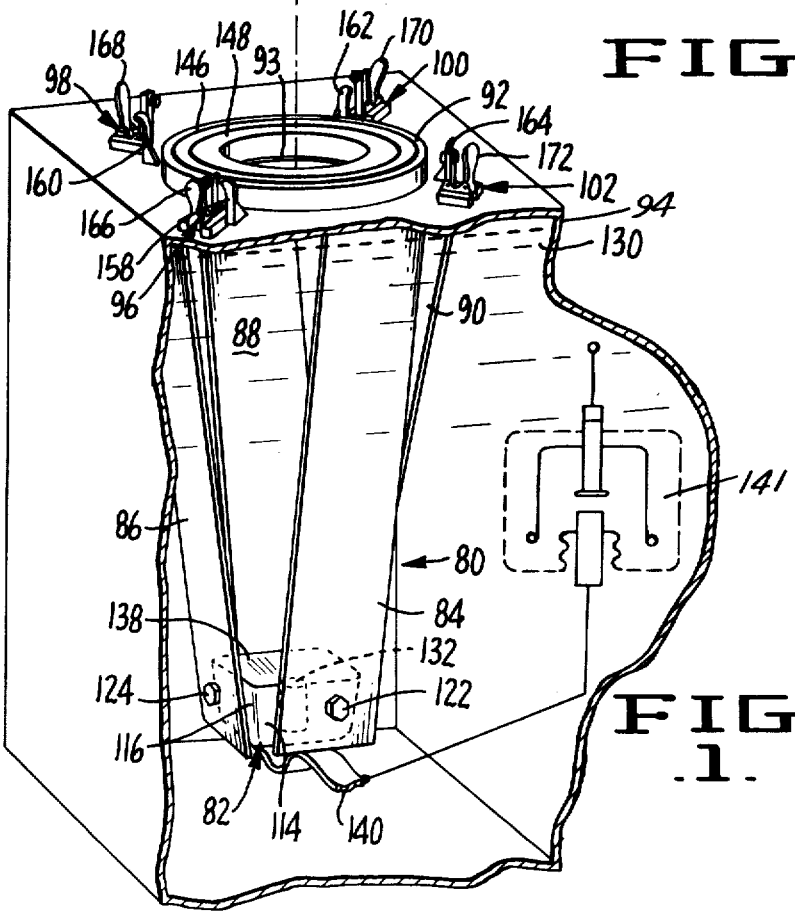
FIG. 1 is a perspective view of a fuse assembly and fuse mount constructed in accordance with a preferred embodiment of the present invention.

Referring now to FIG. 1, there is shown a fuse assembly and fuse mount constructed in accordance with the preferred embodiment of the present invention and adapted for carrying out the method of the present invention.

The fuse assembly 10 of FIG. 1 includes a vacuum fuse 12, such as a Type VF vacuum fuse sold by McGraw-Edison Company, having two ferrules 14, 16 projecting from its opposite ends.

Figure 6:
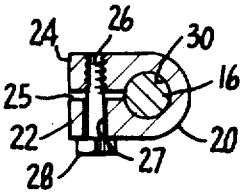
FIG. 6 is a plan view in section taken along line 6—6 of FIG. 3.

In accordance with a principal feature of the present invention, ferrule 16 of vacuum fuse 12 is provided with a coaxial, cylindrical extension 18. As best seen by comparison of FIGS. 3 and 6, extension 18 is integral with a sleeve 20 which surrounds ferrule 16, and sleeve 20 is provided with ears 22 and 24 separated by a slot 25. Ear 24 (FIG. 6) is provided with a tapped hole into which is threaded a bolt 28. Ear 22 (FIG. 6) is provided with a clearance hole 27 through which bolt 28 passes. Thus, sleeve 20 and extension 18 are firmly clamped to ferrule 16 by means inter alia of bolt 28 and separate ears 22 and 24, which serve in the well-known manner to reduce the inner diameter of the bore 30 in which ferrule 16 is located so that bore 30 firmly grasps ferrule 16.

In accordance with said principal feature of the present invention, ferrule 14 of vacuum fuse 12 is provided with a second extension 32. As may be seen by comparison of FIGS. 3, 4, and 5, extension 32 comprises two slotted sleeves 34 (FIG. 5) and 36 (FIG. 4), joined by an integral bridge member 38.

Sleeve 34 is provided with integral ears 40 and 42 (FIG. 5), and a cooperating bolt 44, which together serve to firmly clamp sleeve 34, and thus extension 32, to ferrule 14, in the same manner in which sleeve 20 is clamped to ferrule 16.

Sleeve 36 is in general similar to sleeves 20 and 34, excepting that its bore 46 is provided with threads adapted to receive the male stud of a commercially available bushing well.

Figure 3:
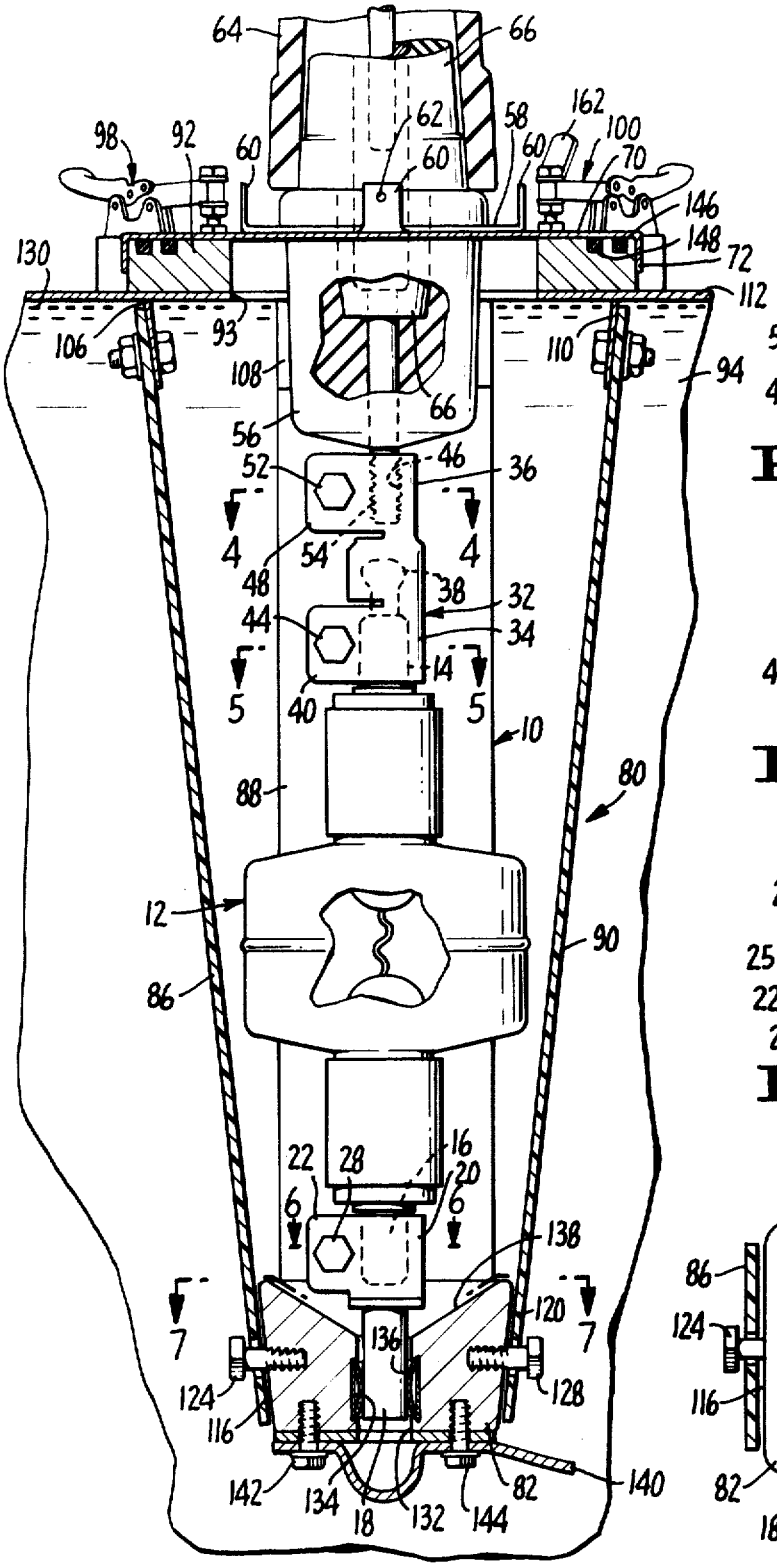
FIG. 3 is a vertical sectional view taken along line 3—3 of FIG. 2.
Figure 4:
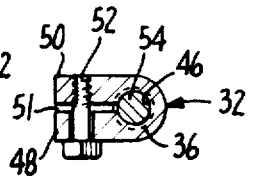
FIG. 4 is a plan view in section taken along line 4—4 of FIG. 3.
Figure 5:
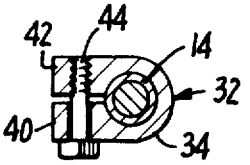
FIG. 5 is a plan view in section taken along line 5—5 of FIG. 3.

As seen in FIG. 4, sleeve 36 is provided with two ears 48 and 50 separated by a slot 51, and a cooperating bolt 52, which serve inter alia to firmly clamp sleeve 36 to the male stud 54 of a bushing well 56. Bushing well 56, as procured from commercial sources, is provided with a flange 58 from which a plurality of ears 60 project upwardly (see FIG. 3). As may be seen from FIGS. 1 and 3, each of the ears 60 is itself provided with a hole 62 adapted to receive one of the extremities of a bail by means of which a connector 64 (FIG. 3) is clamped to bushing well 56 and bushing insert 66 when the fuse assembly of the present invention is in place in the fuse mount of the present invention and operating.

Further in accordance with said principal feature of the present invention, a flanged cover plate 70 is affixed to flange 58, as best seen in FIG. 3.

As also seen in FIG. 3, cover plate 70 is provided with a flange 72, extending from the main body of cover plate 70 toward vacuum fuse 12, and extending completely around its periphery. The joint between cover plate 70 and the main body of bushing well 56 is made watertight, as by means of a suitable sealing compound of a kind well known to those having ordinary skill in the art, or by welding.

Figure 2:
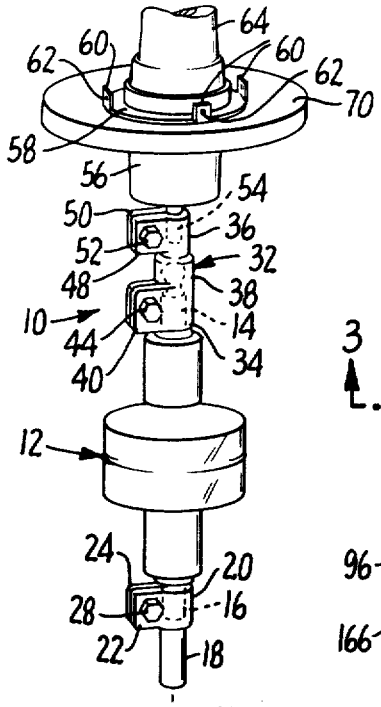
FIG. 2 is a plan view of the fuse assembly and fuse mount of FIG. 1.
Figure 2:
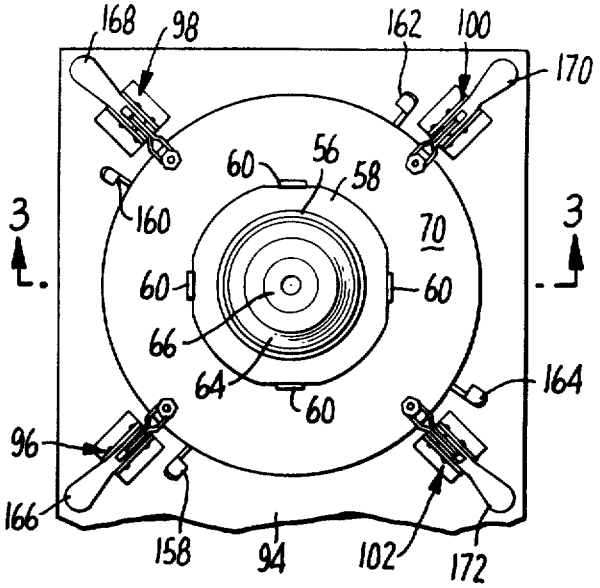
Figure 7:
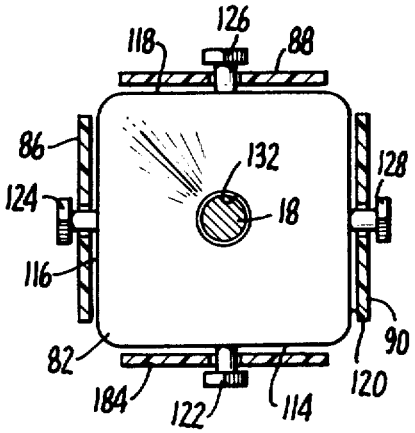
FIG. 7 is a plan view in section taken along line 7—7 of FIG. 3.

Returning now to FIG. 1, and comparing the same with FIGS. 2, 3, and 7, there is shown the fuse mount assembly 80 of the preferred embodiment. As best seen in FIG. 1, fuse mount 80 comprises a contact block 82, four electrically insulating contact block suspenders 84, 86, 88, and 90, a sealing ring 92 surrounding an opening 93 in the top of tank 94, and four toggle clamps 96, 98, 100, and 102. Ring 92 and toggle clamps 96, 98, 100, and 102 are all affixed to tank top 112, as by welding.

Going to FIG. 3, it will be seen that the upper ends of insulating suspenders 86, 88, and 90 are affixed to brackets 106, 108, and 110, respectively. Brackets 106, 108, and 110 are affixed to the inner face of tank top 112, as by welding. An additional bracket 104 (not shown) is provided for affixing the upper end of insulating suspender 84 (FIG. 1) to the inner face of tank top 112. The suspenders are affixed to their associated brackets by means, for example, of nuts and bolts (FIG. 3).

In accordance with a particular feature of the present invention, contact block 82 is so affixed to the lower ends of suspenders 84, 86, 88, 90 that it can tilt or move from side to side slightly to accommodate small misalignments of its associated extension 18.

Contact block 82 has four flat, angulated faces, only two of which, i.e., 114, 116, are shown in FIG. 1. The upper edges of all four flat, angulated faces 114, 116, 118, 120 are shown in FIG. 7. As best seen in FIG. 7, the distances between opposite faces 114 and 118, and 116 and 120, are less than the distances between opposite suspenders 84 and 88, and 86 and 90. Further, as best seen in FIG. 7, the screws 122, 124, 126, and 128 which secure contact block 82 between the lower ends of suspenders 84, 86, 88 and 90 pass through clearance holes in their associated suspenders, and the heads of these screws are not brought up tight against the outside faces of their associated suspenders. Thus, contact block 82 is maintained between the lower ends of suspenders 84, 86, 88, 90 in such manner as to be capable of tilting and/or translating to a limited extent to accommodate slight misalignments or displacements of extension 18.

It should be particularly noted that in accordance with a principal feature of the present invention contact block 82 is *not* enclosed in a sealed container and thus sealed off from contact with the body of insulating oil 130 contained in tank 94, but rather is immersed in a single body of insulating oil 130 which extends through the spaces between the suspenders 84, 86, 88, 90, and occupies the space therebetween which is not occupied by contact block 82. Thus, as best seen in FIG. 1, the body of insulating oil 130 is directly accessible through opening 93 in the top of tank 94 when fuse assembly 10 has been completely removed from fuse mount 80.

Referring now to FIG. 3, it will be seen that contact block 82 contains a central bore 132 of slightly larger diameter than extension 18. It will also be seen that the wall of bore 132 is provided with a recess 134. Recess 134 takes the form of a hollow cylinder and is of such depth and axial length as to close-fittingly receive and hold a contact strip 136 in the form of a cylinder. Contact strip 136 is preferably a contact strip of the louvered type, such as the type made and sold by Multi-Contack AG, of Basel, Switzerland, under the tradename MC-Multilam, and described in U.S. Pat. No. 3,453,587. As also seen in FIG. 3, extension 18 is of such diameter that when deeply engaged in bore 132 it is in solid contact with the individual contact louvers of contact strip 136.

Contact block 82 is also provided with a conical upper surface 138 (FIG. 3) which is coaxial with and terminates in bore 132. A flexible lead 140 such as a flat copper strap consisting of a plurality of thin, flexible copper laminations is attached to the lower face of high-conductivity contact block 82, as by means of bolts 142 and 144 which are threaded into tapped holes in contact block 82. Flexible lead 140 serves to interconnect vacuum fuse 12 with the electrical apparatus in tank 94 (not shown), such as a vacuum switch. As will be evident from FIG. 1, tank 94 is shown only in part, the part containing the associated electrical apparatus (e.g., a vacuum switch or transformer) being omitted.

When fuse assembly 10 is in its operating position in fuse mount 80, as shown in FIG. 3, the lower surface of cover plate 70 bears against the O-rings 146, 148 which are contained in suitable circular channels in the top surface of sealing ring 92. The toggle clamps 96, 98, 100, and 102 may be toggle clamps of the type made and sold by the De-Staco Company under Catalog No. 205-USS. Sealing ring 92 and toggle clamps 96, 98, 100, and 102 may all be welded to the top plate of tank 94. When fuse assembly 10 is in place in tank 94, and toggle clamps 96, 98, 100, and 102 have been operated into their clamping positions by means of a hook stick, cover plate 70 is tightly clamped against O-rings 146 and 148 (FIG. 3), and thus opening 93 in the top of tank 94 is sealed against the admission of water when tank 94 is located in a flooded equipment vault.

A plurality of upstanding guides 158, 160, 162, and 164 are affixed to the top of tank 94, as by welding.

Method of Use

Let it be assumed that fuse assembly 10 is in operating position in tank 94, as shown in FIG. 3, that tank 94 is located in a flooded equipment vault, and that vacuum fuse 12 has blown.

In order to replace vacuum fuse 12 the vault must first be pumped out in the conventional manner, whereafter connector 64 would be removed from bushing insert 66 and bushing well 56 by means of an ordinary hook stick, also in the conventional manner.

Fuse assembly 10 must then be removed from tank 94. In order to remove fuse assembly 10 from tank 94, a lineman first opens toggle clamps 96, 98, 100, and 102 by raising their handles 166, 168, 170, and 172, respectively, (FIG. 2) with an ordinary hook stick until the handles are substantially vertical and the pressure arms and pads of the toggle clamps are clear of cover plate 70, as seen in FIG. 1.

The lineman then grasps bushing insert 66 by means of a fuse clamp on an ordinary hot line tool and raises fuse assembly 10 upward until extension 18 is well clear of the top of tank 94, as shown in FIG. 1.

At this stage of the operation of replacing fuse 12 it may be desired or necessary to disassemble sleeves 20 and 34 from the ferrules 14, 16 of blown fuse 12 by means of bolts 28 and 44, and then to lock sleeves 20 and 34 onto the ferrules of a new unblown fuse substantially identical to vacuum fuse 12 by means of the same bolts. As will now be obvious to those having ordinary skill in the art, taught by the present disclosure, the arrangement of the preferred embodiment makes it very easy to replace fuse 12 in fuse assembly 10 with a new fuse of the same kind in the field.

It may be, however, that in some power systems using the fuse mounting method and apparatus of the present invention it is preferred to stock complete fuse assemblies like fuse assembly 10 shown in the present drawings, rather than stocking fuses only. It is to be understood that both practices fall within the scope of the present invention.

In replacing fuse assembly 10 in fuse mount 80 the lineman uses a fuse clamp on an ordinary hot line tool to grasp bushing insert 66, and then, by means of the hot line tool, positions fuse assembly 66 directly over opening 93 in the top of tank 94, as shown in FIG. 1. The lineman then lowers fuse assembly 10 into opening 93 by means of the hot line tool. As fuse assembly 10 approaches its seated or operating position the lower end of extension 18 will, in most instances, contact the conical upper surface 138 of contact block 82. Conical upper surface 138, because of its conical configuration and because this cone terminates in bore 132, serves to guide extension 18 into bore 132. At the same time, guides 158, 160, 162, and 164 will prevent cover plate 70 from becoming interengaged with any of the toggle clamps 96, 98, 100, and 102, which are then in their open state or condition, as shown in FIG. 1, and also will prevent the lower edges of flange 72 from contacting and cutting O-rings 146 and 148. As the lineman continues to move fuse assembly 10 downwardly into tank 94 by means of the hot line tool and fuse clamp grasping fuse insert 66, extension 18 will become engaged with the louvers of contact strip 136 in bore 132, thus making solid contact between lower ferrule 16 of fuse 12 and the piece of electrical equipment (not shown) which is contained with fuse 12, via sleeve 20, extension 18, contacts 136, contact block 82, and flexible, laminated conductive strap 140. Just before cover plate 70 is seated on sealing ring 52, against O-rings 146 and 148, outer flange 72 of cover plate 70 will come to closely surround the periphery of sealing ring 92, thus maintaining the upper end of fuse assembly 10 in alignment with bore 132. When cover plate 70 is seated on sealing ring 92, and thus fuse assembly 10 is in its seated or operating position (shown in FIG. 3), fuse 12 will be completely immersed in the same body of insulating oil 130 in which the apparatus protected by fuse 12 is immersed. The lineman then unclamps the hot line tool from bushing insert 66 and closes toggle clamps 96, 98, 100, and 102, i.e., operates them into the position shown in FIG. 1, by means of an ordinary hot stick. The operation of replacing fuse 12 is then completed by reconnecting connector 64 by bushing insert 66 and bushing well 56 in the conventional manner. It will now be understood how, employing the method and apparatus 141 of the present invention, fuse 12 can quickly, easily, and safely be replaced by the use of ordinary hot line tools, fuse 12 then being in direct, heat-conducting contact with the body of insulating fluid 130 in tank 94, whereby much more effective cooling of fuse 12 is provided than is provided by prior art methods and apparatus. Thus, much larger current capacity fuses, with higher voltage ratings in some cases, may be mounted in the same equipment tanks with the electrical apparatus being protected, and the size and cost of the tanks and associated vaults, etc., considerably reduced.

Figure 8:
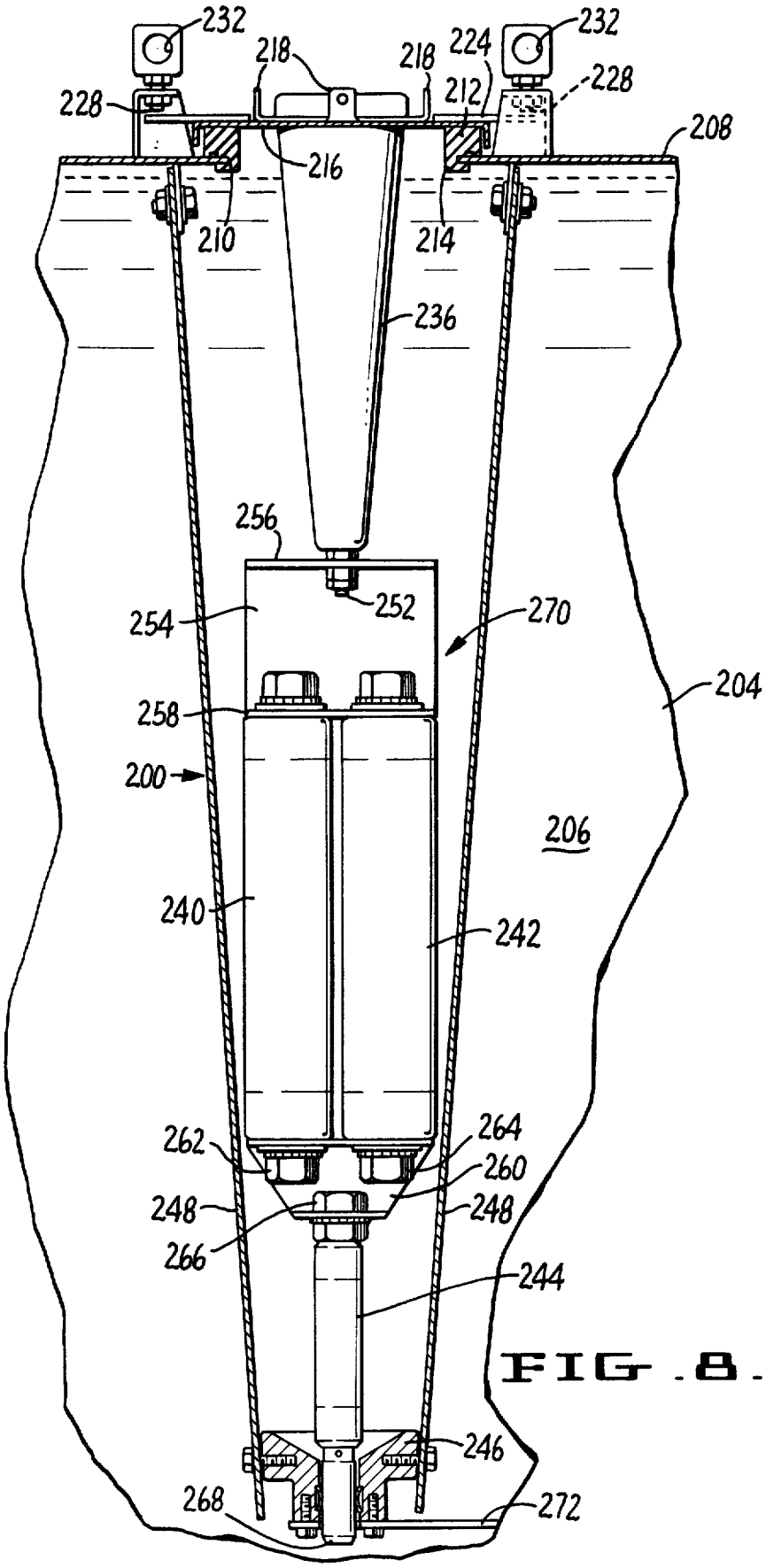
FIG. 8 is a partial elevational view, partly in section, of electrical equipment embodying my invention which makes use of one of said assemblies of different fuses.

Referring now to FIG. 8, there is shown a fuse mount assembly 200 constructed in accordance with a second preferred embodiment of the present invention.

The major portion of fuse mount assembly 200 as seen in FIG. 8 is immersed in transformer oil contained in a tank 204, of which only one wall 206 and the top 208 are shown (both partially only).

As also seen in FIG. 8, the upper end of fuse mount assembly 200 passes through an opening 210 in tank top 208.

In accordance with a particular feature of my invention a unitary, resilient ring 212 fabricated, for example, from Buna rubber replaces the metallic sealing ring 92 and O-rings 146, 148 of the first preferred embodiment of the present invention, as seen in FIG. 3.

As may be seen in FIG. 8, resilient sealing ring 212 is provided with a generally L-shaped continuous flange 214 which engages the edge of opening 210 and thereby maintains resilient sealing ring 212 in place. Cover plate 216 and ears 218 are generally similar to cover plate 70 and ears 60 of the embodiment of FIG. 3.

Unlike cover plate 70, however, cover plate 216 is provided with a plurality of outwardly-projecting beams 224 which can be maneuvered to bring their outer ends directly below bolts 228 by rotating cover plate 216 by means of an ordinary hook stick. Cover plate 216 may then be sealingly pressed against sealing ring 212 by means of bolts 228 the heads of which are enlarged and provided with openings 232 adapted to receive an ordinary hook stick.

Bushing well 236 of fuse mount assembly 200 functions in the same manner as bushing well 56 of FIG. 3, and may also be procured from commercial sources. Ears 218 will commonly be part of commercial bushing well 236.

Fuse mount assembly 200 further comprises fuses 240, 242, and 244. Fuses 240 and 242 may, e.g., be 8.3 kilovolt or 15.5 kilovolt R-T-E type "ELSP" current limiting fuses. Fuse 244 may, e.g., be an R-T-E fault sensing expulsion fuse.

Contact block 246 of this second preferred embodiment of the present invention may in general be substantially identical to contact block 82 of the embodiment of FIG. 3.

A plurality of contact block suspenders 248, which are fabricated from insulating material, serve to maintain contact block 246 in a predetermined position with respect to opening 210, in substantially the same manner in which contact block suspenders 86, etc., of FIG. 3 serve to position contact block 82 of FIG. 3 with respect to opening 93.

Returning to FIG. 8, it will be seen that the upper ferrules of fuses 240 and 242 are rigidly affixed to the ferrule 252 of bushing well 236 by means of a coupling member 254. Coupling member 254 is provided with upper and lower integral flanges 256, 258, which are provided with openings adapted to receive ferrule 252 and the upper ferrules of fuses 240 and 242.

As also seen in FIG. 8, suitable nuts, etc., are provided for securing coupling member 254 to ferrule 252 and the upper ferrules of fuses 240 and 242. Thus, when said bolts are engaged with the threads of said ferrules and properly tightened down, the ferrules passing through the associated openings in flanges 256 and 258, bushing well 236 and fuses 240 and 242 are joined into a substantially rigid assembly.

Similarly, fuse 244 is substantially rigidly coupled to fuses 240 and 242 by means of coupling member 260, bolts 262, 264, 266, etc.

Coupling members 254 and 260 are formed from highly conductive material, and thus a conductive path through fuse mount assembly 200 exists from the lower ferrule of fuse 244 to the plug recepticle in the top of bushing well 236.

As may also be seen from FIG. 8, by those having ordinary skill in the art, informed by the present disclosure, the lower ferrule of fuse 244 is provided with an extension 268 the lower end of which is adapted to engage the Multilam contacts in block 246. Extension 268 may be affixed to the lower ferrule of fuse 244 by threaded engagement with the lower ferrule of fuse 244 if it is unthreaded. It is to be understood, however, that the term "ferrule" as used herein is used in the broad acceptation of that term in the electrical fusing art, and thus embraces both threaded and unthreaded ferrules.

It will now be understood by those having ordinary skill in the art, informed by the present disclosure, that fuse mount assembly 200 comprises a fuse assembly comparable to fuse assembly 10 of FIG. 1, including cover plate 216, bushing well 236, coupling member 254, fuses 240 and 242, coupling member 260, fuse 244, and extension 268. The fuse assembly of FIG. 8, referred to herein by the reference numeral 270, is a unitary assembly which may be mounted in or removed from the remaining portion of fuse mount assembly 200 in the manner taught hereinabove.

Fuse mount assembly 200 of FIG. 8 is provided with a connecting conductor 272 for connecting contact block 246 to electrical apparatus in tank 204, as fuse mount assembly 80 of FIG. 1 is provided with connecting conductor 140.

It will thus be seen that the objects set forth above, among those made apparent from the preceding description are efficiently attained. Since certain changes may be made in carrying out the above method and in the construction set forth without departing from the scope of the invention, it is intended that all matter contained in the above description or shown in the accompanying drawings shall be interpreted as illustrative only and not in a limiting sense.

It is particularly noted that although the present invention has been disclosed by way of an embodiment in which toggle clamps are employed to assist in sealing the cover plate to the tank top, the present invention may be carried out by using other types of hot line tool manipulable clamps, or even bolts, such as wing bolts with large wings easily graspable by a clamp on a hot line tool. Further, the sealing ring need not be secured to the top of the tank by means of welding, but rather it may be found more convenient to bolt the sealing ring to the top of the tank, interposing one or more O-rings therebetween. Also, it may be found desirable to employ an insulating gas such as air instead of insulating oil in some embodiments of the present invention. Gaskets of other types than O-rings may be used to seal the cover plate to the sealing ring, or the sealing ring to the tank top. Further, the hole in the tank top may be enlarged and the suspenders for the contact block affixed to the sealing ring, rather than to the inside face of the tank top. Other types of contacts may be employed in the bore in the contact block. Furthermore, it may be desired in some applications of the present invention to suspend the contact block by means of a single suspender which is continuous and thus separates the body of insulating fluid which is in contact with the fuse from the body on insulating fluid which is in contact with the electrical apparatus protected by the fuse, although the full benefits of the present invention will not be realized thereby. Also, the bushing well (e.g., Elastimold K1601PC), bushing insert (e.g., Elastimold 2601A2), and connector or cable termination (e.g., 264LR) used in the preferred embodiment to connect ferrule 14 of fuse 12 to the associated power line may be replaced by any number of different types of bushings, either submersible or air insulated, and either of one piece construction or comprising a separate bushing well and bushing insert. Yet further, the suspenders and contact block may be so constructed and arranged as to make it unnecessary to fit the lower ferrule of the fuse with an extension. The invention also finds use in explosive atmospheres.

It is also to be understood that the following claims are intended to cover all of the generic and specific features of the invention herein described, and all statements of the scope of the invention which, as a matter of language, might be said to fall therebetween.

The word "foraminous" is used herein in its broadest acceptation to denote any surround or enclosure which does not completely block the passage of fluid between its exterior and its interior.

What is claimed is:

1. The method of mounting fuse means having a first ferrule and a second ferrule in a tank containing electrical power equipment surrounded by insulating fluid, comprising the steps of:

affixing to said first ferrule a conductor which passes through and is sealed to a cover for covering an opening in a wall of said tank;

passing said fuse means through said opening and into said insulating fluid; and connecting said second ferrule to a connector suspended in and contacted by said insulating fluid while positiong said cover over said opening.

2. The method claimed in claim 1 in which said fuse means comprises a plurality of fuses, further comprising the step of intercoupling said fuses into a substantially rigid assembly by securing coupling means to ferrules of said fuses other than said first ferrule and said second ferrule.

3. The method of mounting fuse means as claimed in claim 1, further comprising the step of affixing to said second ferrule a conductive extension terminating in a ferrule adapted to engage said connector.

4. The method claimed in claim 3 in which said fuse means comprises a plurality of fuses, further comprising the step of intercoupling said fuses into a substantially rigid assembly by securing coupling means to ferrules of said fuses other than said first ferrule and said second ferrule.

5. The method of replacing fuse means having a first ferrule and a second ferrule enclosed in the same tank with and immersed in the same body of insulating fluid as electrical power equipment, comprising the steps of:

disconnecting one ferrule of said fuse means from its associated power line without displacing said fuse means;

withdrawing said fuse means from said body of insulating fluid and from said tank;

immersing replacement fuse means in said body of insulating fluid; and connecting said replacement fuse to said power line.

6. The method claimed in claim 5 in which said replacement fuse means comprises a plurality of replacement fuses, further comprising the step of intercoupling said replacement fuses into a substantially rigid assembly by securing coupling means to ferrules of said replacement fuse means other than the ferrules thereof adapted to function as said first and second ferrules.

7. A submersible component for an electrical power system, comprising:

a closed tank containing a body of insulating fluid and electrical power equipment, said electrical power equipment being surrounded and contacted by said body of insulating fluid;

fuse means comprising a plurality of fuses and having outwardly extending ferrules;

suspender means for suspending a connector for connection to one ferrule of said fuse means within and in contact with said body of insulating fluid;

an opening in a wall of said tank through which said fuse means may be withdrawn from said body of insulating fluid and from said tank after being disconnected from said connector; and cover means for covering said opening;

a second ferrule of said fuse means being attached to a conductor which passes through insulating bushing means, said insulating bushing means passing through and being sealed to said cover means.

8. A submersible component as claimed in claim 7 in which said electrical power equipment is a vacuum switch.

9. An enclosure for electrical power equipment, comprising:

a tank capable of containing electrical power equipment and a body of insulating fluid surrounding and contacting it, and having an opening through one of its walls large enough to admit a fuse assembly comprising a plurality of fuses and having outwardly extending ferrules, and cover means for said opening;

insulating bushing means passing through and sealed to said cover means;

connector means for making connection with one ferrule of said fuse assembly;

means for affixing said fuse assembly to said insulating bushing means and connecting a ferrule of said fuse assembly to a conductor which passes through said insulating bushing means; and suspender means for so suspending said connector means in said tank that said body of insulating fluid will surround and contact said fuse assembly when one of its ferrules is connected to said connector means.

10. A submersible component for an electrical power system, comprising:

a closed tank containing a body of insulating fluid and electrical power equipment, said electrical power equipment being surrounded and contacted by said body of insulating fluid;

a fuse assembly comprising a plurality of fuses and having outwardly extending ferrules;

suspender means for suspending a connector for connection to one ferrule of said fuse assembly within and in contact with said body of insulating fluid;

an opening in a wall of said tank through which a fuse assembly may be withdrawn from said body of insulating fluid and from said tank after being disconnected from said connector; and cover means for covering said opening;

a second ferrule of said fuse assembly being attached to a conductor which passes through an insulating bushing; said insulating bushing passing through and being sealed to said cover means.

11. A submersible component as claimed in claim 10 in which said electrical power equipment is a vacuum switch.

* * * * *